US005339921A

United States Patent [19]

Faupel

[11] Patent Number: 5,339,921

[45] Date of Patent: Aug. 23, 1994

[54] LADDER LEVELING DEVICE

[76] Inventor: Dana C. Faupel, R.D. 2, Box 102, Buffalo Mills, Pa. 15534

[21] Appl. No.: 91,956

[22] Filed: Jul. 12, 1993

[51] Int. Cl.[5] ..... E06C 7/00

[52] U.S. Cl. ..... 182/111; 182/200; 248/237

[58] Field of Search ..... 182/111, 108, 107, 214, 182/200, 115, 45; 248/237, 188.2, 157, 148

[56] References Cited

U.S. PATENT DOCUMENTS

| | | | |
|---|---|---|---|
| 298,463 | 5/1884 | Guedle | 248/237 X |
| 590,872 | 9/1897 | Allen | 248/237 X |
| 2,888,225 | 5/1959 | McQuin | 248/237 |
| 4,342,374 | 8/1982 | Montana | 248/237 X |
| 4,457,397 | 7/1984 | Scala | 182/200 X |
| 4,842,229 | 6/1989 | Murray | 248/237 X |
| 4,846,305 | 7/1989 | Kupfert | 182/111 |
| 5,004,072 | 4/1991 | Launer | 248/237 X |
| 5,078,231 | 1/1992 | Davis | 182/107 |

FOREIGN PATENT DOCUMENTS

| | | | |
|---|---|---|---|
| 2663075 | 12/1991 | France | 182/107 |
| 2160570 | 12/1985 | United Kingdom | 182/107 |
| 2216168 | 10/1989 | United Kingdom | 182/108 |

*Primary Examiner*—Karen J. Chotkowski
*Attorney, Agent, or Firm*—Thomas E. Sterling

[57] ABSTRACT

A ladder leveling device used in conjunction with a ladder on sloping ground or roof surfaces. This device may be adjusted to the slope of the ground or roof and is placed under one or both legs of a two-legged ladder. The device is comprised of a horizontal plate upon which the ladder leg rests, a vertical plate attached to the end portion of the horizontal plate, an adjustment plate with adjustment grooves therethrough which is adjustably bolted to the vertical plate. A swiveling anti-skid-plate is connected to the lower edge of the adjustment plate and adjusts itself to the slope of the roof or ground.

8 Claims, 2 Drawing Sheets

Fig. 3.
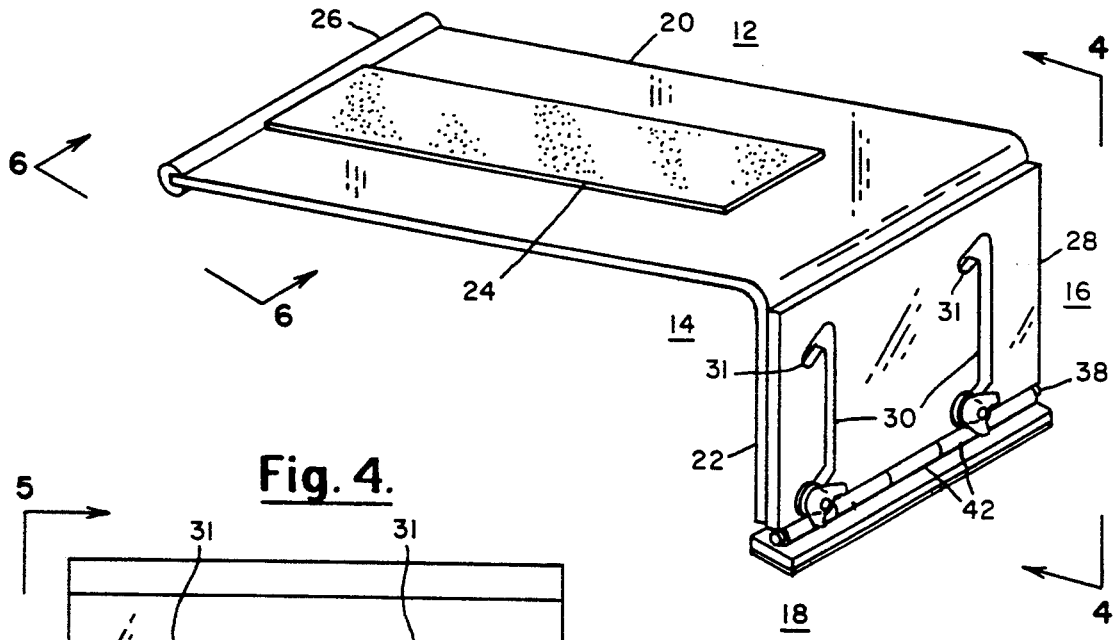
Fig. 4.
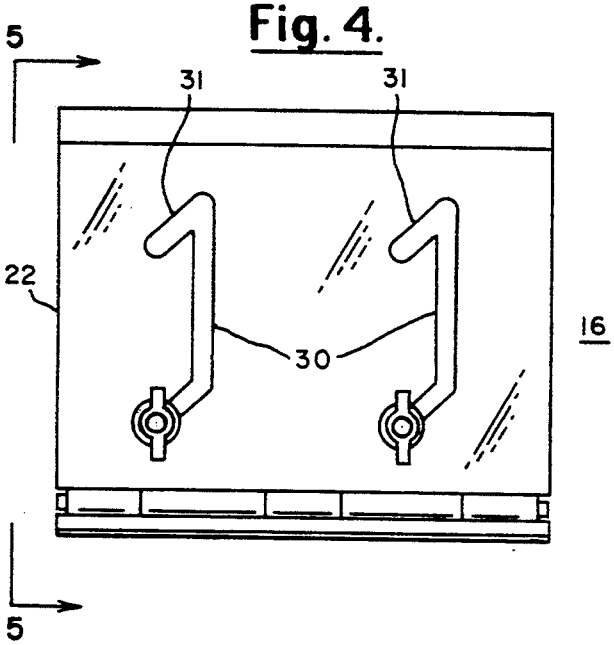
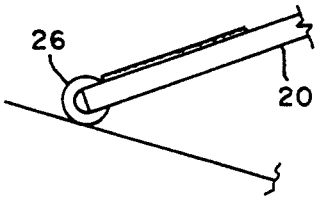
Fig. 6.
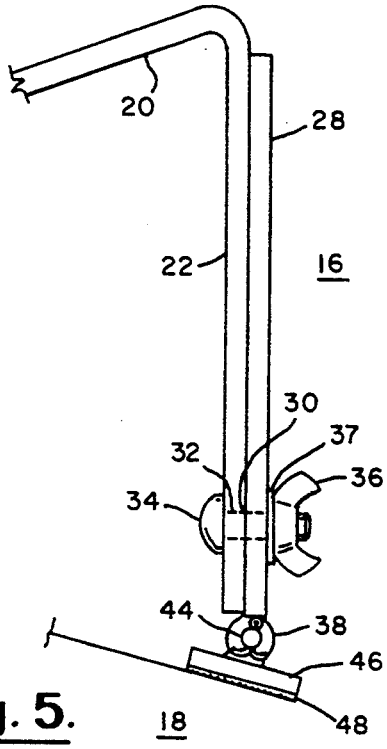
Fig. 5.

LADDER LEVELING DEVICE

FIELD OF INVENTION

The present invention relates generally to the field of ladders and more specifically to devices for leveling the foot of the ladder on sloping ground or sloping roof. The device provides a surface that is approximately horizontal for the leg or legs of a ladder to rest.

BACKGROUND OF THE INVENTION

There are many types of ladder leveling inventions as may be seen from the following list. However this invention is unique in that it presents an adjustable ladder leveling device having an anti-skid plate swivel connected along its length to the bottom free edge of the adjustable support plate. This innovation allows the ladder leveler to retain its friction and its position on roofs or sloping ground in that the swivel connected to the anti-skid plate will assume the angle of the ground or roof and develop maximum friction preventing the device from slipping. In addition the device has an adjustment device making it operable on different slopes and anti-skid elements preventing the device from slipping.

The inventor's preliminary patent search revealed the following patents relating to ladder leveling devices. The inventor knows of no other patents which closely anticipate his invention. U.S. Pat. Nos. 298,463; 739,309; 1,492,483; 1,822,786; 2,496,556; 3,993,275; 4,135,335; 4,304,318; 4,342,374; 4,699,247; 4,776,548; 4,830,320; 5,004,072.

SUMMARY OF THE INVENTION

The invention generally consists of a wedge shaped object having a horizontal plate thereon and a connecting vertical plate attached to the end portion of the horizontal plate. The vertical plate is bolted to a separate adjustment plate which has vertical adjustment groove therethrough. The adjustable bolts extend through the vertical plate and through an adjustment groove in the adjustment plate in such a manner that the adjustment plate may be slid up and down and tightened to the correct height by tightening wing nuts on the bolts. The bottom portion of the adjustment plate has a swiveling connection to a anti-skid plate attached to the adjustment plate by means of a hinge. Thus when the Ladder Leveler is set on a sloping surface and adjusted to the proper height, the swivel connection to the anti-skid plate will assume the angle of the sloping surface on which the device rests. An anti-skid mat is secured to the upper surface of the horizontal plate and an anti-skid tube extends across the end portion of a anti-skid plate in contact with the sloping surface. A second anti-skid mat is secured to the bottom portion of the anti-skid plate where it contacts the sloping surface. The swiveling anti-skid plate will then conform to the sloping surface and allow an anti-skid mat thereon to bear against the sloping surface creating maximum friction. The adjustment plate has downwardly disposed locking grooves extending from the vertical adjustment groove therethrough. These locking grooves may be positioned upon the adjustable bolt, thus assuring that the adjustment plate will remain secure.

As may be seen, the Ladder Leveler is placed on the sloping surface and in one or both legs of the ladder placed on the horizontal plate which is in approximately a horizontal position after adjustment. If adjustment is necessary, the adjustable bolts are loosened and the adjustment plate moved up or down in such a position that the horizontal plate will be in about a horizontal position. A swivel connected anti-skid device is secured to the bottom portion of the adjustment plate by means of a hinge in such a manner that it may rotate and assume the slope of the sloping surface on which it rests. The swivel connected anti-skid plate allows maximum friction to be created between the anti-skid plate and sloping surface. The anti-skid plate has an anti-skid mat secured thereto which will additionally increase friction. This coupled with the anti-skid tube on the horizontal plate produces sufficient friction so that the Ladder Leveler device will not slip. The swivel connected anti-skid plate is a innovation in ladder levelers and produces a desirable and hitherto unknown feature of such devices.

In operation, the Ladder Leveler device is placed upon a sloping roof or ground and the adjustment plate is approximately in horizontal position. Either one or both legs of a ladder are then placed on the anti-skid mat on the horizontal plate and leaned against the vertical surface to be climbed. The ladder is then secure and may be ascended and used without danger of slippage. The Ladder Leveler may be easily removed and readjusted to a variety of sloping surfaces making it an agile, simple and desirable device to use.

OBJECTS OF INVENTION

It is therefore an objective of the present invention to provide an inexpensive and simple ladder leveling device which will support a ladder on a sloping roof or on sloping ground.

It is another objective of this invention to provide a ladder leveling device having a swiveling anti-skid device which will position itself on a sloping roof to produce a superior friction gripping on a roof or on sloping ground.

It is yet another objective of this invention to provide an inexpensive, simple and adjustable ladder leveling device which may be adjusted to operate on a variety of sloping surfaces.

These and other objectives of the present invention will be apparent on reading the specifications in conjunction with the accompanying drawings.

BRIEF DESCRIPTION OF THE DRAWINGS

FIG. 3 is a perspective view of the invention.

FIG. 4 is a view taken along line 4—4 of FIG. 3.

FIG. 5 is a view taken along line 5—5 of FIG. 4, showing the invention resting on a sloping surface.

FIG. 6 is a view taken along line 6—6 of FIG. 5 showing the friction tube resting on a sloping surface and the cut off segment of the anti-skid mat.

DETAILED DESCRIPTION

Figure 1:
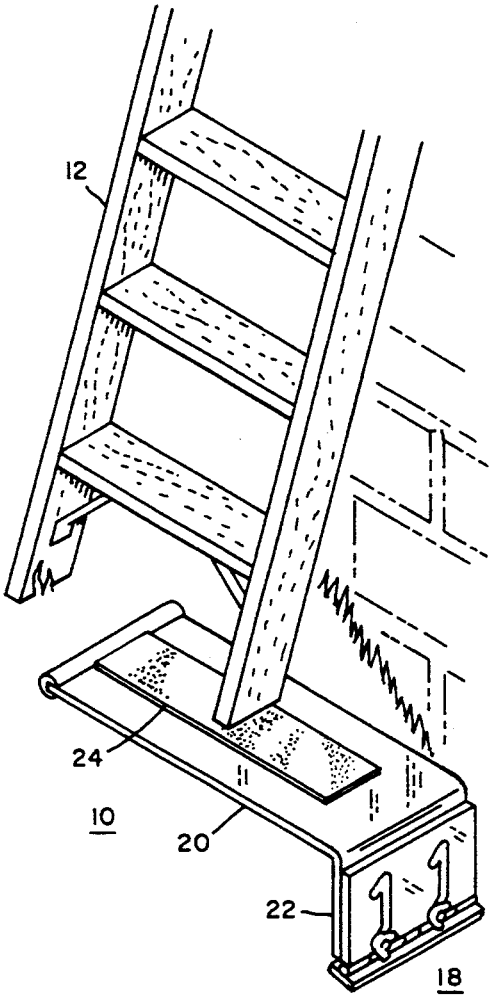
FIG. 1 is a perspective view of the invention installed on sloping ground with one leg of a ladder thereon.

As can be seen by reference to the drawings the Ladder Leveler invention 10 is generally comprised of a horizontal support unit 12, a vertical unit 14, adjustable vertical support unit 16 and a swivel anti-skid unit 18. These units will be described in detail as we proceed with the description of this invention.

Horizontal support unit 12 and vertical support unit 14 are generally comprised of horizontal plate 20 and joined vertical plate 22 respectively. Horizontal plate 20 and vertical plate 22 are frequently made of a single plate such as aluminum or fiberglas and bent to an angle. This angle may vary between zero and 180 degrees. The angle between 45 to 135 degrees was found to be most convenient. The end portion of the horizontal plate 20 has a friction tube surface 26 extending there across. This friction tube 26 surface will bear against supporting roof or ground preventing slippage. The friction tube 26 may be made of rubber, plastic or other friction producing materials. An anti-skid mat 24 is secured longitudinally to the upper surface of horizontal plate 20 and meant to receive one or both legs of a ladder 12 as seen in FIG. 1. Anti-skid mat 24 may also support two legs of a ladder 13 as is set forth in FIG. 2. Anti-skid mat 24 may also be made of rubber, plastic or other friction producing materials and may be cemented to horizontal plate 20.

A vertical plate 22, attached to horizontal plate 20, is abutted against a rectangularly shaped adjustment plate 28. Adjustment plate 28 has vertical adjustment slots 30 therethrough. The end Portions of adjustment slots 30 are connected to angularly positioned locking slots 31 also extending through adjustment plate 38. The lower portion of vertical plate 22 has adjustment holes 32 therethrough which mate with the adjustment slots 30 and locking slots 31 in adjustment plate 28.

Adjustment bolts 34 extend through adjustment hole 32 and through adjustment slots 30 or the locking slots 31 of adjustment plate 28. A wing nut 36 is thread attached to adjustable bolt 34 and adapted to bear against adjustment plate 28 through a washer 37. There may be several locking slots 31 in the adjustable plate 28 extending from adjustment slots 30. As may be seen, by tightening wing nuts 36, adjustment plate 38 is pressed against vertical plate 22. Bolts 30 are positioned to be in the lowest portion of locking slots 31 which positions horizontal plate 20 in an approximate horizontal position on a sloping surface. Hence any weight upon horizontal plate 20 will bear against locking slots 31. Tightening wing nuts 36 insures that adjustment plate 28 will remain secured to vertical plate 22 when a ladder 12 or 13 is placed upon the horizontal plate 20.

Swivel anti-skid unit 18 is secured to the bottom portion of adjustment plate 28. Swivel anti-skid unit 18 is comprised of a hinge 38 attached to the lower portion of adjustment plate 28 and to a swivel anti-skid plate 46, having a anti-skid mat 48 on the bottom portion thereof. Anti-skid mat 48 is made of rubber, plastic or other friction producing material. Hinge 38 is comprised of annular segments 42 half some of which are secured to adjustment plate 28 and some to swivel anti-skid plate 46. A hinge pin 44 extends through all annular segments 42 in the manner of a conventional hinge. Thus it may be seen that swivel anti-skid plate 46 will rotate about hinge 38 and will conform to the angular surface of roof or ground upon which it rests. This may be seen in FIG. 5. By conforming to the angle of roof or ground, the anti-skid plate 46 and anti-skid mat 48 will present a maximum anti-skid surface to prevent the slippage of anti-skid mat 48. In addition, friction tube 26 will bear against the roof or ground producing additional traction to prevent the invention from slipping.

Figure 2:
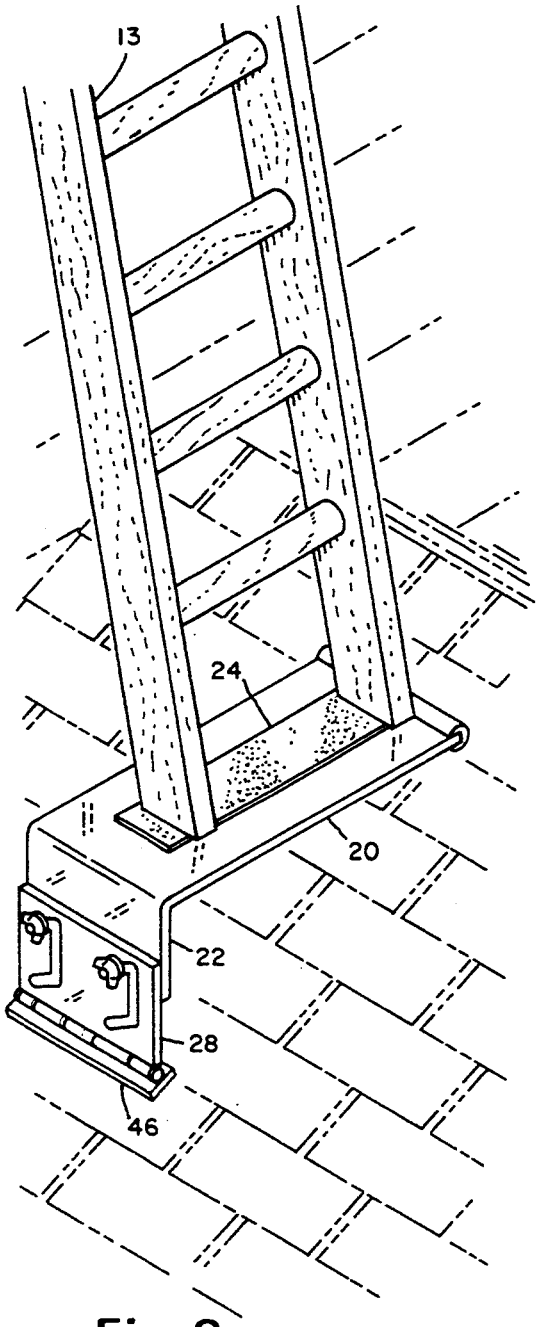
FIG. 2 is a perspective view of the invention installed on a roof with both two legs of a ladder thereon.

In operation, the adjustment plate 28 of the Ladder Leveler device 10 is set in the locking slot 31 necessary to maintain an approximately horizontal position of horizontal plate 20. Wing nut 36 is tightened pressing adjustment plate 28 against vertical plate 22 thus insuring no slippage. Friction tube 26 and anti-skid mat 48 are pressed against the ground or roof as shown in FIG. 1 and FIG. 2. The swivel anti-skid plate 46 will conform to the angular surface of ground or roof thus increasing the friction between anti-skid mat 48 and the supporting surfaces, preventing slippage. A ladder 12 or 13 is then placed on the anti-skid mat 48. The legs of the ladder 12 or 13 are then approximately horizontal. The ladder 12 or 13 will be securely supported at its base. The ladder 12 or 13 may then be climbed in safety by the using workman.

As may be seen the Ladder Leveler device can be adjusted to operate on a variety of pitches of roof or ground. It is contemplated that the length of adjustment slots 30 may be increased and the number of locking slots 31 increased to give a number of adjustments to Ladder Leveler 10. The anti-skid mat 24 prevents ladder leg slippage, while anti-skid mat 48 and friction tube 26 will bear against the sloping surface to further prevent the device from slipping. In addition, the end portions of hinge pin 44 may have cotter pins therethrough to contain the hinge pin 44 within hinge 40.

Although this invention has been described with a certain degree of particularity, it is to be understood that other embodiments and modifications are possible without departing from the true scope and spirit of the invention.

I claim:

1. In combination with a ladder or like device, a ladder leveling device positionable on a sloping surface and adapted to provide a resting surface for a ladder leg comprising in combination:

a horizontal support unit adapted to support a ladder or like device;

a vertical support unit attached to said horizontal support unit and extending outwardly therefrom;

an adjustment unit attached to said vertical support unit adapted to adjust the height of said adjustment unit;

a swivel anti-skid unit attached to said adjustment unit said swivel anti-skid unit is comprised of a hinge attached to said adjustment unit, an anti-skid plate attached to said hinge, and an anti-skid mat attached to said anti-skid plate;

said horizontal support unit is comprised of a support element positioned approximately horizontally, an anti-skid mat integrally attached to said support element, and a friction element connected to the end portion of said support element;

said vertical support unit is comprised of a support plate integrally connected to said support element, said support plate having an adjustment hole therethrough;

said adjustment unit is comprised of an adjustment plate adjacent to said support plate, said adjustment plate having an adjustment groove therethrough positioned adjacent to said adjustment hole, and a clamping unit extending through said adjustment groove and said adjustment hole;

wherein said adjustment groove extends approximately vertical and has a locking groove extending downwardly and outwardly from an end portion of said adjustment groove, said locking groove extending through said adjustment plate;

whereby the load upon said horizontal support plate is transmitted to said clamping unit which is positioned against an end portion of said locking groove thereby securing said clamping unit thereto.

2. The combination as claimed in claim 1 in which said clamping unit is comprised of a clamping bolt extending through said adjustment hole and said adjustment groove, and a nut thread engaged to said clamping bolt.

3. The combination as claimed in claim 2 in which said clamping bolt is in a sliding mode within such adjustment groove and said locking groove.

4. The combination as claimed in claim 3 in which a single ladder leg rests upon said anti-skid mat and a second ladder leg rests upon said sloping surface.

5. The combination as claimed in claim 4 in which more than one ladder leg rests upon said anti-skid mat.

6. The combination as claimed in claim 5 in which cylindrically shaped tube made of rubber.

7. The combination as claimed in claim 2 in which a thrust washer is positioned on said bolt between said nut and said adjustment plate.

8. The combination as claimed in claim 1 having more than one locking groove therein.

* * * * *